US010235916B2

(12) United States Patent
Park et al.

(10) Patent No.: US 10,235,916 B2
(45) Date of Patent: Mar. 19, 2019

(54) APPARATUS AND METHOD FOR CORRECTING IMAGE DISTORTION AND CURVED DISPLAY DEVICE INCLUDING THE SAME

(71) Applicant: LG Display Co., Ltd., Seoul (KR)

(72) Inventors: JongHwan Park, Paju-si (KR); YeonShim Shim, Paju-si (KR); JiHee Song, Paju-si (KR); SangLyn Lee, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 198 days.

(21) Appl. No.: 14/928,910

(22) Filed: Oct. 30, 2015

(65) Prior Publication Data

US 2016/0133169 A1 May 12, 2016

(30) Foreign Application Priority Data

Nov. 10, 2014 (KR) ..... 10-2014-0155718

(51) Int. Cl.
*G09G 3/20* (2006.01)

(52) U.S. Cl.
CPC ..... *G09G 3/20* (2013.01); *G09G 2320/068* (2013.01); *G09G 2354/00* (2013.01); *G09G 2380/02* (2013.01)

(58) Field of Classification Search
CPC ..... G09G 3/20; G09G 2380/02; G09G 2320/068; G09G 2354/00
See application file for complete search history.

(56) References Cited

U.S. PATENT DOCUMENTS 6,297,814 B1 10/2001 Masuda et al.
9,927,368 B1 * 3/2018 Olsson ..... G01N 21/8803
2003/0231261 A1 12/2003 Bassi et al.
2007/0120869 A1 * 5/2007 Nishida ..... G09G 3/3607 345/611
2010/0079683 A1 4/2010 Kobori et al.
(Continued)

FOREIGN PATENT DOCUMENTS

CN 1213809 4/1999
CN 1659867 8/2005
(Continued)

OTHER PUBLICATIONS

First Office Action for Chinese Patent Application No. CN 201510762855.2, dated Sep. 7, 2017, 20 Pages (With English Translation).
(Continued)

*Primary Examiner* — Patrick N Edouard
*Assistant Examiner* — Joseph P Fox
(74) *Attorney, Agent, or Firm* — Fenwick & West LLP

(57) ABSTRACT

An apparatus for correcting image distortion may correct a luminance level of image data in accordance with a curvature of a curved display panel in a curved display device and a viewing distance of a viewer and display an image optimized for the curvature and the viewing distance on a full area of the curved display panel, whereby an image having no distortion may be provided to the viewer. The apparatus for correcting image distortion includes a virtual curved surface generator, a coordinate mapping unit, and a luminance converter.

16 Claims, 5 Drawing Sheets

(56) References Cited

U.S. PATENT DOCUMENTS

| | | | | |
|---|---|---|---|---|
| 2012/0235893 | A1* | 9/2012 | Phillips | G06F 3/012 345/156 |
| 2013/0321456 | A1* | 12/2013 | Hultquist | G01C 21/3667 345/629 |
| 2014/0118319 | A1* | 5/2014 | Jeon | G06F 1/00 345/207 |
| 2014/0292621 | A1* | 10/2014 | Kim | H04N 5/64 345/76 |

FOREIGN PATENT DOCUMENTS

| | | |
|---|---|---|
| CN | 101017316 | 8/2007 |
| CN | 101715091 | 5/2010 |
| CN | 103019478 | 4/2013 |

OTHER PUBLICATIONS

2nd Office Action for Chinese Patent Application No. CN 201510762855.2, dated Apr. 9, 2018, 9 Pages.

* cited by examiner

APPARATUS AND METHOD FOR CORRECTING IMAGE DISTORTION AND CURVED DISPLAY DEVICE INCLUDING THE SAME

CROSS-REFERENCE TO RELATED APPLICATION

Pursuant to 35 U.S.C. § 119(a), this application claims the benefit of earlier filing date and right of priority to Korean Application No. 10- 2014-0155718, filed on Nov. 10, 2014, the contents of which is incorporated by reference herein in its entirety.

BACKGROUND

1. Field of Technology

The present invention relates to an apparatus for correcting image distortion and more particularly, to an apparatus and method for correcting image distortion caused by a curved surface of a display panel in a curved display device having a curved display panel and the curved display device including the same.

2. Background

With the development of information society, a display device that may display information has been actively developed. Examples of the display device include a liquid crystal display device, an organic electro-luminescence display device, a plasma display panel, and a field emission display device.

The aforementioned display devices are flat display devices formed in a flat shape. However, the aforementioned flat display devices have been recently developed as curved display devices and commercialized. The curved display device forms a curved display panel that maintains a fixed curvature and provides images with the intensified immersion to viewers.

However, since the curved display device has a bigger change in a viewing angle than the flat display device, a problem occurs in that image is distorted in accordance with a change of a viewing angle.

FIGS. 1A and 1B illustrate an example of images displayed in a flat display device and a curved display device.

Referring to FIGS. 1A and 1B, a first object d1 displayed on a center of a screen of each of a flat display device 10 and a curved display device 20 is moved to one side of the screen and then displayed as a second object d2 or a third object d2'. Since a viewer views the second object d2 or the third object d2' at a viewing distance longer than a viewing distance of the first object d1 at the center, the viewer feels that the second object d2 and the third object d2' are smaller than the first object d1. In this case, vertical lengths H of the flat display device 10 and the curved display device 20 are the same as each other, and resolution of the flat display device 10 is also the same as that of the curved display device 20.

At this time, as shown in FIG. 1A, the flat display device 10 displays the second object d2 reduced from the first object d1 at a fixed rate in up/down/left/right directions. However, as shown in FIG. 1B, the curved display device 20 displays the third object d2' reduced from the first object d1 at an irregular rate in up/down/left/right directions. Therefore, the viewer views the third object d2' distorted non-linearly.

That is, the curved display device 20 provides images having the intensified immersion to the viewers but displays non-linearly distorted images in horizontal and vertical directions in accordance with a viewing distance and a curvature. This is because that the image input to the curved display device 20 is a flat image taken by a camera of which image pickup surface is a flat surface.

As described above, the curved display device 20 displays a flat image as it is, whereby image distortion is generated at the outside. This image distortion causes inconvenience when the viewer views the curved display device 20.

SUMMARY

Therefore, an object of the present invention is to solve the aforementioned problems. Another object of the present invention is to provide an apparatus and method for correcting image distortion in a curved display device.

To achieve these and other advantages and in accordance with the purpose of this specification, as embodied and broadly described herein, according to one aspect of the present invention, an apparatus for correcting image distortion comprises a virtual curved surface generator, a coordinate mapping unit, and a luminance converter.

The virtual curved surface generator generates a virtual curved surface having a plurality of virtual pixels in accordance with a viewing distance and a curvature radius.

The coordinate mapping unit maps coordinates of each of the plurality of virtual pixels of the virtual curved surface and each of a plurality of actual pixels of a curved display panel.

The luminance converter outputs image data of which luminance level is reconfigured for each of the plurality of actual pixels in accordance with a superimposed level of each of the plurality of virtual pixels superimposed on each of the plurality of actual pixels by coordinate mapping.

The apparatus for correcting image distortion according to the present invention may correct a luminance level of image data in accordance with a curvature of the curved display panel in the curved display device and a viewing distance of a viewer and display an image optimized for the curvature and the viewing distance on a full area of the curved display panel, whereby an image having no distortion may be provided to the viewer.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION

Description will now be given in detail of the exemplary embodiments, with reference to the accompanying drawings. For the sake of brief description with reference to the drawings, the same or equivalent components will be provided with the same reference numbers, and description thereof will not be repeated.

For convenience of description, a liquid crystal display device having a curved display panel will be described exemplarily as a curved display device in the present invention. However, it will be apparent that the present invention is not limited to the liquid crystal display device and may be used for all display devices, which may have a curved display panel, such as an organic light emitting display device, in addition to the liquid crystal display device.

Figure 1A:
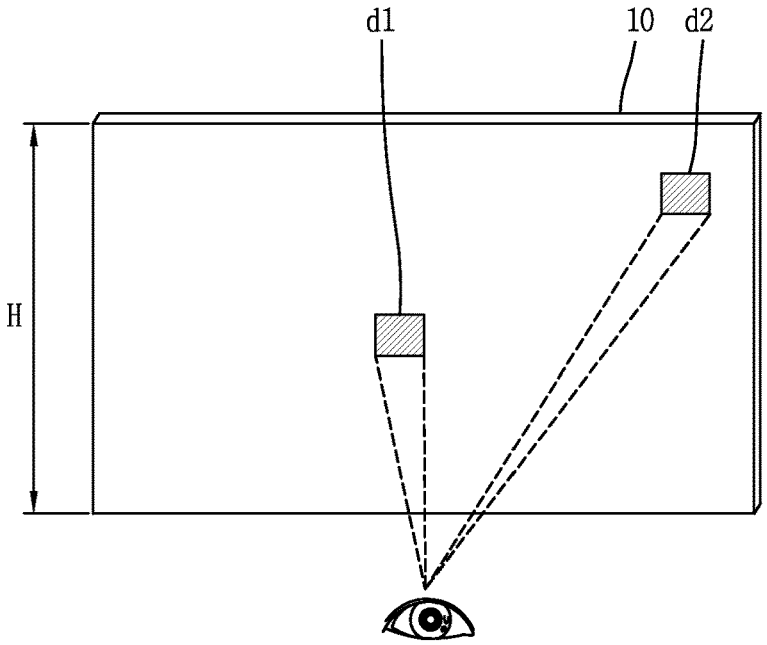
FIG. 1A RELATED ART
FIGS. 1A and 1B illustrate examples of images displayed in a flat display device and a curved display device.
Figure 1B:
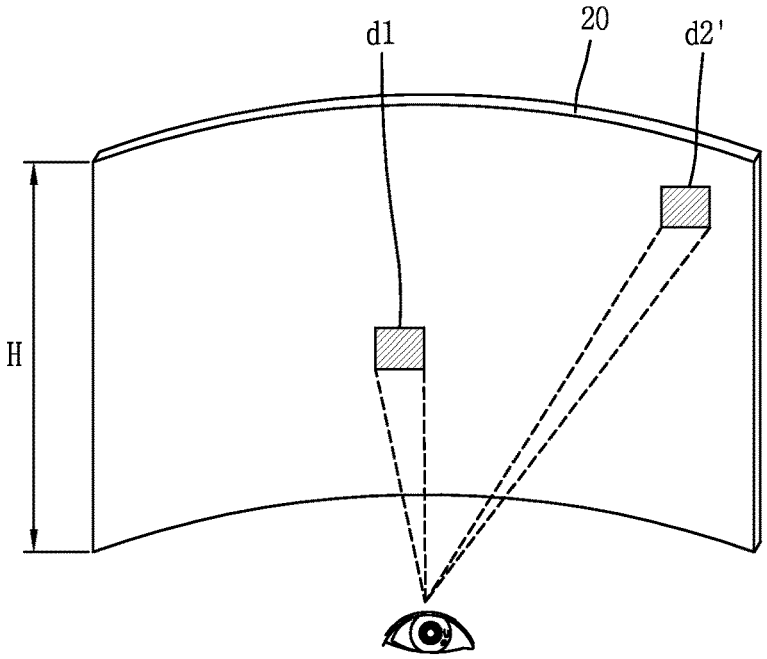
FIG. 1B RELATED ART
Figure 2:
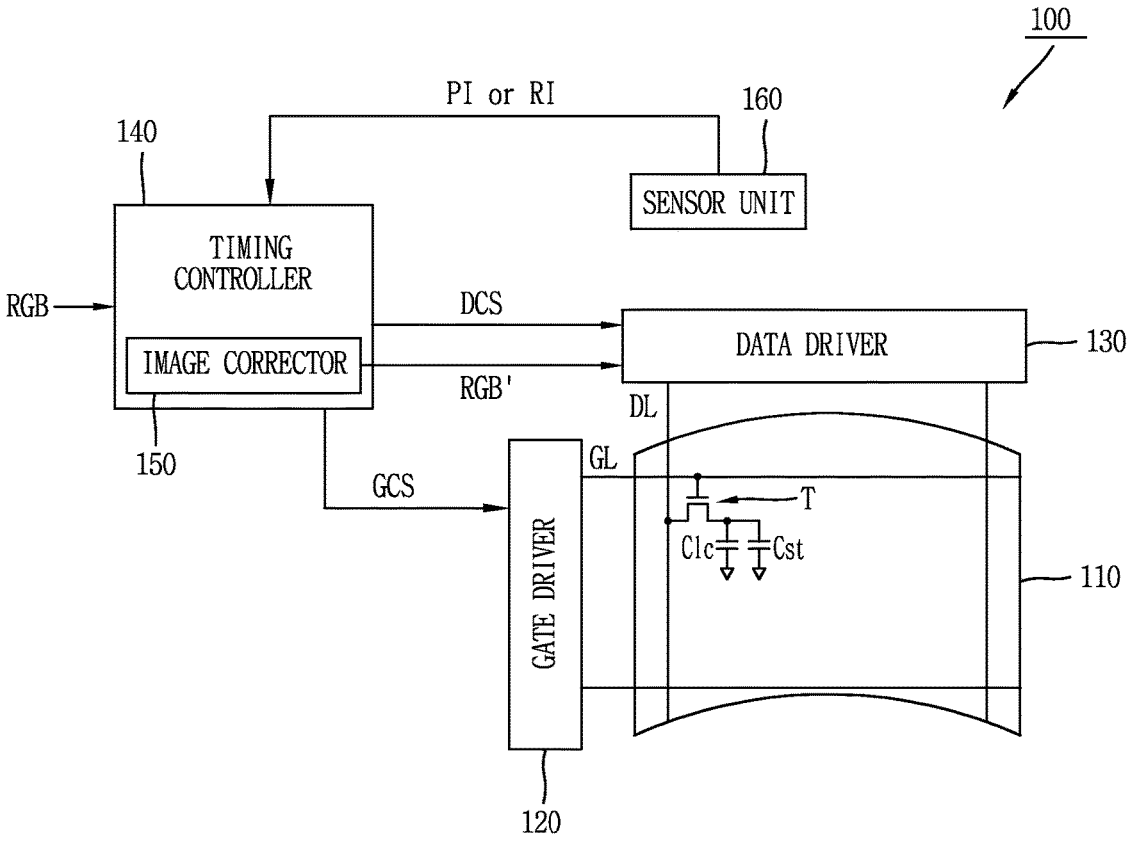
FIG. 2 illustrates a curved liquid crystal display device according to one embodiment of the present invention.

FIG. 2 illustrates a curved liquid crystal display device according to one embodiment of the present invention.

Referring to FIG. 2, the curved liquid crystal display device 100 according to this embodiment may include a curved display panel 110, a gate driver 120, a data driver 130, a timing controller 140, and a sensor unit 160.

The curved display panel 110 may include a liquid crystal layer (not shown) interposed between two substrates (not shown). The curved display panel 110 may be formed to have a predetermined curvature.

A plurality of gate lines GL and a plurality of data lines DL may be formed in the curved display panel 110 to cross each other, thereby defining pixels. Each pixel may be provided with a thin film transistor T, a storage capacitor Cst and a liquid crystal capacitor Clc.

The gate driver 120 may generate a gate signal in accordance with a gate control signal GCS provided from the timing controller 140 and output the gate signal to the plurality of gate lines GL of the curved display panel 110 in due order.

The data driver 130 may generate a data signal from image data RGB' in accordance with a data control signal DCS provided from the timing controller 140 and output the data signal to the plurality of data lines DL of the curved display panel 110. In this case, the data driver 130 may generate the image data RGB' output from an image corrector 150, which will be described later, that is, the data signal from the image data RGB' of which image distortion is corrected.

The timing controller 140 may generate a gate control signal GCS and a data control signal DCS from a control signal provided from an external system (not shown). The gate control signal GCS and the data control signal DCS may be output to the gate driver 120 and the data driver 130, respectively.

The gate control signal GCS may include a gate start pulse GSP, a gate shift clock GSC, and an output enable signal GOE. The data control signal DCS may include a source start pulse SSP, a source sampling clock SSC, an output enable signal SOE, and a polarity control signal POL.

The timing controller 140 may further include the image corrector 150. The image corrector 150 may generate image data RGB' by correcting the image signal RGB provided from the external system to allow the image signal RGB to be displayed on the curved display panel 110 without distortion.

The image corrector 150 may correct the image signal RGB in accordance with a distance between the curved display panel 110 and a viewer, that is, a viewing distance and a curvature level of the curved display panel 110, that is, a curvature radius of the curved display panel 110. In this case, the image corrector 150 may correct the image signal RGB by using one of the viewing distance and the curvature radius. The viewing distance and the curvature radius may be calculated in accordance with information provided from the sensor unit 160.

The sensor unit 160 may output a sensing value by sensing a position of the viewer or the curvature level of the curved display panel 110. The sensor unit 160 may include a first sensor (not shown) and a second sensor (not shown).

The first sensor may generate viewer position information P1 by sensing a current position of the viewer. In this case, the first sensor may generate viewer position information P1 by sensing a pupil position of the viewer. The first sensor may be a camera located on a front surface of the curved liquid crystal display device 100, an ultrasonic distance sensor or a laser sensor.

The second sensor may generate display panel curvature information RI by sensing a curvature of the curved display panel 110. The second sensor may be a modified sensor that may sense a modified level of the curved display panel 110.

Meanwhile, if the curvature of the curved display panel 110 is fixed, the second sensor of the sensor unit 160 may be omitted. And, a memory (not shown) in which the curvature information RI of the curved display panel 110 is stored may further be provided.

Figure 3:
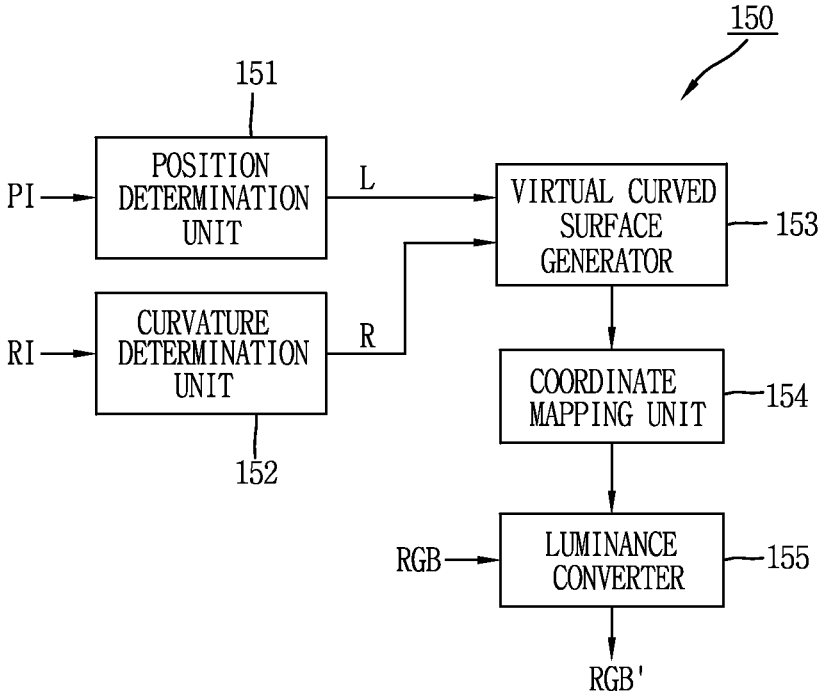
FIG. 3 illustrates a configuration of an image corrector shown in FIG. 2 according to one embodiment.
Figure 4:
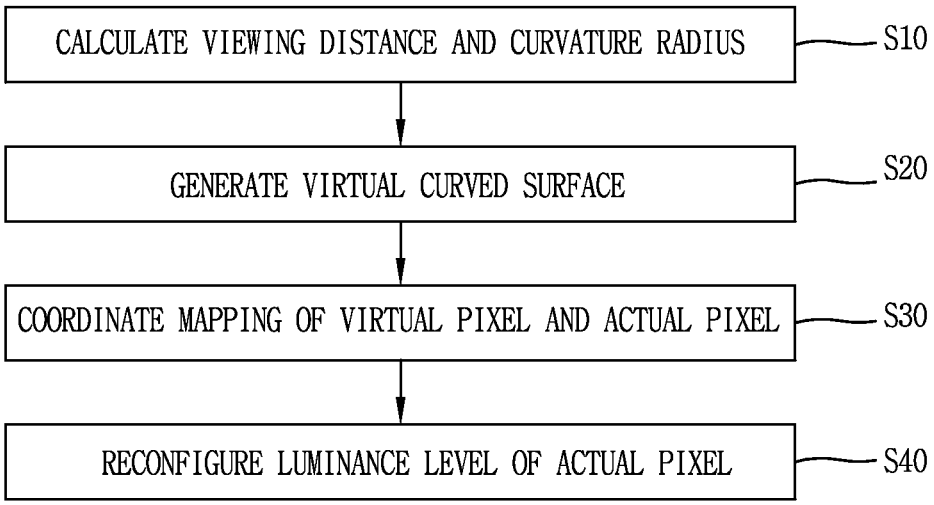
FIG. 4 is a flow chart illustrating an operation of an image corrector according to one embodiment.

FIG. 3 illustrates a configuration of an image corrector shown in FIG. 2, and FIG. 4 is a flow chart illustrating an operation of an image corrector.

Referring to FIGS. 2 to 4, the image corrector 150 may generate the image data RGB' by correcting the image signal RGB to prevent the image signal RGB, which is externally provided, from being displayed in a distorted manner on the curved display panel 110, as described above.

For example, a size of an image viewed by the viewer through a screen, that is, a size of an object varies depending on an angle straying out of the center of the screen, that is, a line-of-sight angle. At this time, the size of the object is seen as being reduced at a fixed rate on the flat display panel, whereas the size of the object is seen as being reduced at an irregular rate on the curved display panel 110. At this time, distortion of the object increases in severity on the screen of the curved display panel 110 as the object becomes far away from the center, that is, as the object is oriented from the center of the screen to the outside.

Therefore, the image corrector 150 may generate the image data RGB' by correcting the image signal RGB to allow the size of the object to be reduced at a fixed rate and then to be displayed even on the curved display panel 110 in the same manner as the flat display panel.

To this end, the image corrector 150 may include a position determination unit 151, a curvature determination unit 152, a virtual curved surface generator 153, a coordinate mapping unit 154, and a luminance converter 155.

The position determination unit 151 and the curvature determination unit 152 may calculate and output a viewing distance L and a curvature radius R from information provided from the aforementioned sensor unit 160, that is, viewer position information P1 and display panel curvature information RI (S10).

The position determination unit 151 may calculate the viewing distance L in accordance with the viewer position information PI provided from the first sensor of the sensor unit 160. The viewing distance L may be calculated by a straight line distance from the object displayed on the curved display panel 110 to the viewer.

The curvature determination unit 152 may calculate the curvature radius R of the curved display panel 110 from the display panel curvature information RI provided from the second sensor of the sensor unit 160. The curvature radius R may mean a curved level of the curved display panel 110.

Figure 5:
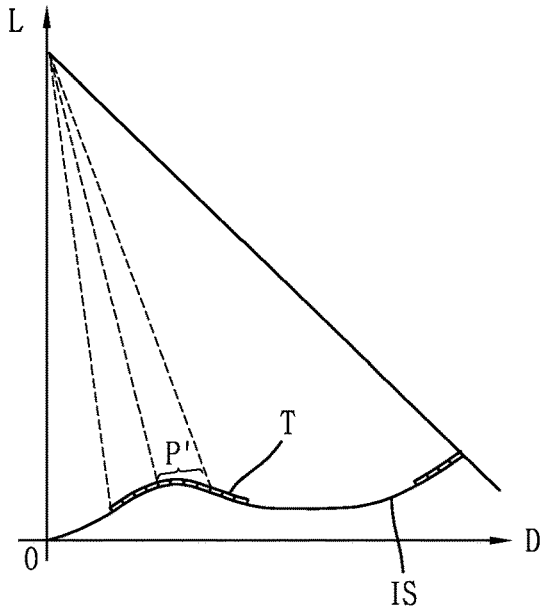
FIG. 5 illustrates an operation of a virtual curved surface generator of an image corrector according to one embodiment.

The virtual curved surface generator 153 may generate a virtual screen of the curved display panel 110, that is, a virtual curved surface IS, as shown in FIG. 5, in accordance with the viewing distance L and the curvature radius R provided respectively from the position determination unit 151 and the curvature determination unit 152 (S20).

The virtual curved surface generator 153 may generate a virtual curved surface IS in which a size ratio of an object displayed on the center of the screen of the curved display panel 110 and an object displayed on the outside of the screen is uniformly provided.

For example, if a first object is displayed on the center of the screen of the flat display panel and then is moved to a side of the screen and displayed as a second object, the second object is displayed with a size reduced at a fixed rate in comparison with the first object, whereby image distortion is not generated.

In order to prevent image distortion from being generated even in the curved display panel 110, the second object should be displayed with a size reduced at a fixed rate in comparison with the first object in the same manner as the flat display panel. To this end, the virtual curved surface generator 153 may generate a virtual curved surface IS such that a ratio of horizontal lengths and vertical lengths of the first object and the second object has a value of 1.

The virtual curved surface generator 153 may generate the virtual curved surface IS from the following Equation 1.

$$\frac{H'}{H} = \frac{1}{(\cos\gamma)^2}\cos(\rho-\theta)\cos\rho\frac{L}{R(\cos\theta-1)+L} \qquad \text{[Equation 1]}$$

$$\frac{V'}{V} = \frac{1}{\cos\gamma}\cos\rho\frac{L}{R(\cos\theta-1)+L}$$

In this case, H and V represent a horizontal length component and a vertical length component of the first object, and H' and V' represent a horizontal length component and a vertical length component of the second object. Also, γ may be an image signal, that is, an angle between the first object and the second object, which are taken from the camera, and ρ may be image data, that is, an angle between the first object and the second object, which are displayed on the curved display panel. Also, L is the viewing distance, R is the curvature radius, and θ means the angle between the first object and the second object in the curvature radius.

The virtual curved surface generator 153 may generate the virtual curved surface IS such that a ratio of γ and ρ may be 1 in the Equation 1. At this time, γ may be defined as a fixed value within a viewing angle range of the camera that generates the image signal RGB.

Meanwhile, the virtual curved surface generator 153 may generate a virtual curved surface IS of which a curved degree of freedom varies depending on the viewing distance L and the curvature radius R. For example, if the viewing distance L is increased, the virtual curved surface IS generated from the virtual curved surface generator 153 may be generated almost similarly to the curved display panel 110. Also, if the curvature radius R is reduced, the virtual curved surface IS generated from the virtual curved surface generator 153 may be generated almost similarly to the curved display panel 110. That is, the virtual curved surface generator 153 may generate a virtual curved surface IS similar to the curved display panel 110 if the viewing distance L is increased or the curvature radius R is reduced.

Also, the virtual curved surface generator 153 may define a plurality of virtual pixels P' in the virtual curved surface IS. Each of the plurality of virtual pixels P' may have a predetermined luminance level in accordance with the image signal RGB.

Each of the plurality of virtual pixels P' may be comprised of a plurality of tiles T. The plurality of tiles T may allow the virtual curved surface IS to have a flexible curved shape. The plurality of times T may have a size smaller than the virtual pixels P', and may integer-partition the virtual pixels P', whereby the number of virtual pixels P' may be determined As one example, one virtual pixel P' may be comprised of 7 tiles T.

Meanwhile, in FIG. 5, an axis x may mean a screen left/right distance of the display panel, and an axis y may mean a viewing distance.

The coordinate mapping unit 154 may map coordinates of the virtual pixels P' of the virtual curved surface IS and actual pixels P of the curved display panel 110 (S30).

Figure 6:
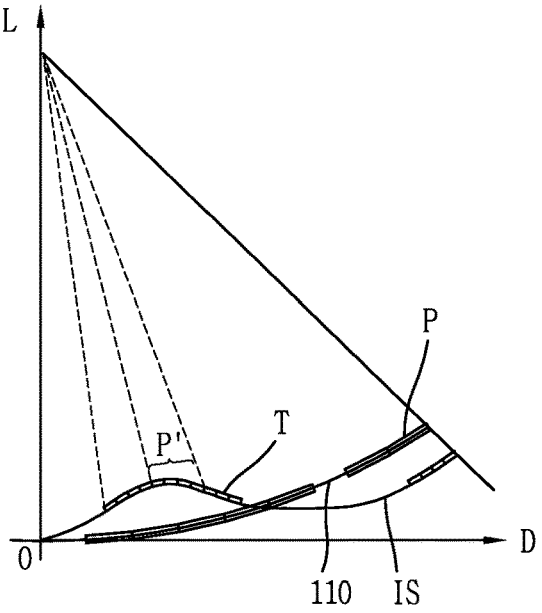
FIG. 6 illustrates an operation of a coordinate mapping unit of an image corrector according to one embodiment.

The coordinate mapping unit 154, as shown in FIG. 6, may calculate coordinates corresponding to the virtual pixels P' from the actual pixels P of the curved display panel 110 by projecting the virtual pixels P' generated in the virtual curved surface IS onto the curved display panel 110. In this case, the coordinate mapping unit 154 may calculate a coordinate of a portion where the virtual pixel P' is superimposed on the actual pixel P, by projecting the virtual pixel P' onto the curved display panel 110 in (0, L).

Meanwhile, in FIG. 6, an axis x may mean a screen left/right distance of the display panel, and an axis y may mean a viewing distance.

The luminance converter 155 may reconfigure luminance levels of the virtual pixel P' and the actual pixel P, which are superimposed on each other, in accordance with coordinate mapping (S40). For example, the luminance converter 155 may reconfigure the luminance level of the actual pixel P from the luminance level of the virtual pixel P' in accordance with a superimposed level of the virtual pixel P' and the actual pixel P.

The luminance converter 155 may generate image data RGB' of which distortion is corrected as the luminance level is reconfigured from the image signal RGB. The luminance converter 155 may output the image data RGB' to the data driver 130.

Figure 7:
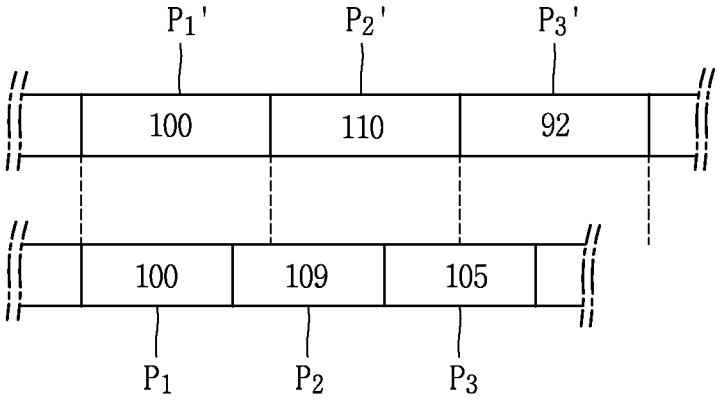
FIG. 7 illustrates an operation of a luminance converter of an image corrector according to one embodiment.

Referring to FIG. 7, the luminance converter 155 may reconfigure the luminance level of the actual pixel P from a superimposed proportion of the virtual pixel P' and the actual pixel P in accordance with coordinate mapping.

For example, a first virtual pixel P1', a second virtual pixel P2' and a third virtual pixel P3' may be generated in the virtual curved surface IS. Also, the first virtual pixel P1' may have a luminance level 100, the second virtual pixel P2' may have a luminance level 110, and the third virtual pixel P3' may have a luminance level 92.

First to third actual pixels P1 to P3 corresponding to the first to third virtual pixels P1' to P3' of the virtual curved surface IS may be located in the curved display panel 110. The first to third actual pixels P1 to P3 may partially be superimposed on the first to third virtual pixels P1' to P3' by coordinate mapping.

The luminance converter 155 may reconfigure the luminance levels of the first to third actual pixels P1 to P3 in accordance with the superimposed levels of the first to third virtual pixels P1' to P3' superimposed on the first to third actual pixels P1 to P3.

For example, since the first actual pixel P1 of the curved display panel 110 is fully superimposed on the first virtual pixel P1' in accordance with coordinate mapping, the luminance level of the first actual pixel P1 may be reconfigured as the luminance level 100 of the first virtual pixel P1'.

Also, since the second actual pixel P2 of the curved display panel 110 is partially superimposed on the first virtual pixel P1' and the second virtual pixel P2' in accordance with coordinate mapping, the luminance level of the second actual pixel P2 may be reconfigured as the luminance level 109 in accordance with the luminance levels of the first virtual pixel P1' and the second virtual pixel P2'.

Also, since the third actual pixel P3 of the curved display panel 110 is partially superimposed on the second virtual pixel P2' and the third virtual pixel P3' in accordance with coordinate mapping, the luminance level of the third actual pixel P3 may be reconfigured as the luminance level 105 in accordance with the luminance levels of the second virtual pixel P2' and the third virtual pixel P3'.

As described above, the luminance converter 155 may reconfigure the luminance level of the actual pixel P from the luminance level of the virtual pixel P' in accordance with the superimposed level of the virtual pixel P' and the actual pixel P, which are subjected to coordinate mapping.

And, the luminance converter 155 may prevent distortion of an image displayed on the curved display panel 110 from being generated by generating and outputting the image data RGB' from the luminance level of the reconfigured actual pixel P.

Meanwhile, the example that the luminance converter 155 reconfigures the luminance level of the actual pixel P of the curved display panel 110 in a unit of pixel has been described in this embodiment. However, the luminance converter 155 may reconfigure the luminance level of the actual pixel P of the curved display panel 110 in a unit of sub pixel.

As described above, the curved liquid crystal display device 100 according to the present invention may reconfigure the luminance level of the image data RGB' applied to each pixel of the curved display panel 110 through the image corrector 150, whereby an image optimized for the viewing distance L and the curvature radius R may be provided to the viewer on a full area of the curved display panel 110 without image distortion.

Meanwhile, in the present invention, it has been described that the image corrector 150 is located inside the timing controller 140. However, the image corrector 150 may be configured as an independent device at a front end or rear end of the timing controller 140. For example, if rendering for the image signal RGB is performed in the timing controller 140, the image corrector 150 may be configured independently at the rear end of the timing controller 140, thereby generating the image data RGB' by performing distortion correction for the image processed by rending.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. An apparatus for correcting image distortion, the apparatus comprising:

a virtual curved surface generator generating a virtual curved surface having a plurality of virtual pixels in accordance with a viewing distance and a curvature radius of a curved display panel having a predetermined curved surface, the virtual curved surface having a curvature radius that is distinct from the curvature radius of the curved display panel;

a coordinate mapping unit mapping each of the plurality of virtual pixels of the virtual curved surface into one or more of a plurality of actual pixels of the predetermined curved surface of the curved display panel, wherein at least one of the plurality of actual pixels is mapped to two or more virtual pixels; and a luminance converter outputting image data of which a luminance level is reconfigured for each of the plurality of actual pixels in accordance with a superimposed level of each of the plurality of virtual pixels superimposed on one or more of the plurality of actual pixels by mapping coordinates, wherein a luminance level of the at least one of the plurality of actual pixels that is mapped to two or more virtual pixels is reconfigured based on luminance levels of the two or more virtual pixels.

2. The apparatus according to claim 1, the apparatus further comprising:

a first sensor generating viewer position information by sensing a position of a viewer; and a position determination unit calculating the viewing distance based on a straight line distance between a screen of the curved display panel and the viewer, from the viewer position information.

3. The apparatus according to claim 1, the apparatus further comprising:

a second sensor generating curvature information by sensing a curvature of the curved display panel; and a curvature determination unit calculating the curvature radius of the curved display panel from the curvature information.

4. The apparatus according to claim 1, wherein each of the plurality of virtual pixels includes a plurality of tiles.

5. The apparatus according to claim 1, further comprising a memory storing the curvature radius.

6. The apparatus according to claim 1, wherein the luminance converter reconfigures a luminance level of each of the plurality of actual pixels in a unit of pixel of the curved display panel.

7. The apparatus according to claim 1, wherein the luminance converter reconfigures a luminance level of each of the plurality of actual pixels in a unit of sub pixel of the curved display panel.

8. A method for correcting an apparatus for correcting image distortion, the method comprising:

generating a virtual curved surface having a plurality of virtual pixels in accordance with a viewing distance and a curvature radius of a curved display panel having a predetermined curved surface, the virtual curved surface having a curvature radius that is distinct from the curvature radius of the curved display panel;

mapping coordinates of each of the plurality of virtual pixels of the virtual curved surface into one or more of a plurality of actual pixels of the predetermined curved surface of the curved display panel, wherein at least one of the plurality of actual pixels is mapped to two or more virtual pixels;

reconfiguring a luminance level of each of the plurality of actual pixels in accordance with a superimposed level of each of the plurality of virtual pixels on one or more of the plurality of actual pixels, which are coordinate-mapped, wherein a luminance level of the at least one of the plurality of actual pixels that is mapped to two or more virtual pixels is reconfigured based on luminance levels of the two or more virtual pixels; and generating and outputting image data from an image signal in accordance with the reconfigured luminance level.

9. The method according to claim 8, wherein generating the virtual curved surface includes generating the virtual curved surface similar to the predetermined curved surface of the curved display panel if the viewing distance is increased.

10. The method according to claim 8, wherein generating the virtual curved surface includes generating the virtual curved surface similar to the predetermined curved surface of the curved display panel if the curvature radius is reduced.

11. The method according to claim 8, wherein mapping the coordinates includes mapping the coordinates of each of the plurality of virtual pixels and each of a plurality of actual pixels by projecting the plurality of virtual pixels onto the curved display panel.

12. The method according to claim 8, wherein reconfiguring the luminance level includes reconfiguring a luminance level of one of the virtual pixels as a luminance level of one of the actual pixels if the one of the actual pixels is superimposed on the one of the virtual pixels.

13. The method according to claim 8, wherein reconfiguring the luminance level includes reconfiguring a luminance level of one of the actual pixels from a luminance level of each of two neighboring virtual pixels if the one of the actual pixels is superimposed on each of the two neighboring virtual pixels.

14. The method according to claim 8, wherein the viewing distance is calculated from a straight line distance from a screen of the curved display panel to a viewer in accordance with viewer position information provided from a sensor.

15. The method according to claim 8, wherein the curvature radius is calculated from curvature information of the curved display panel, which is provided from a sensor.

16. A curved display device comprising:

a curved display panel having a predetermined curved surface;

a data driver outputting a data signal to the curved display panel; and an image corrector generating image data obtained by correcting an image signal which is externally provided and outputting the generated image data to the data driver, wherein the image corrector includes:

a virtual curved surface generator generating a virtual curved surface having a plurality of virtual pixels in accordance with a viewing distance and a curvature radius of the curved display panel, the virtual curved surface having a curvature radius that is distinct from the curvature radius of the curved display panel;

a coordinate mapping unit mapping each of the plurality of virtual pixels of the virtual curved surface into one or more of a plurality of actual pixels of the predetermined curved surface of the curved display panel, wherein at least one of the plurality of actual pixels is mapped to two or more virtual pixels; and a luminance converter outputting image data of which a luminance level is reconfigured for each of the plurality of actual pixels superimposed on one or more of the plurality of virtual pixels by coordinate mapping, wherein a luminance level of the at least one of the plurality of actual pixels that is mapped to two or more virtual pixels is reconfigured based on luminance levels of the two or more virtual pixels.

* * * * *